United States Patent [19]

Gazzara, Sr.

[11] 3,948,243

[45] Apr. 6, 1976

[54] BOW STRING DRAWING AND RELEASING DEVICE

[76] Inventor: Matthew R. Gazzara, Sr., 345 S. White Horse Pike, Hammonton, N.J. 08037

[22] Filed: Dec. 27, 1974

[21] Appl. No.: 536,883

[52] U.S. Cl. ..... 124/35 A
[51] Int. Cl.[2] ..... F41B 3/02
[58] Field of Search..... 124/35 A, 35 R, 41, 24 R, 124/23 R; 273/164, 165; 128/DIG. 15

[56] References Cited

UNITED STATES PATENTS

| | | | |
|---|---|---|---|
| 1,542,159 | 6/1925 | Maxwell | 124/35 A |
| 2,488,597 | 11/1949 | Konold | 124/35 A |
| 2,819,707 | 1/1948 | Kayfes et al. | 124/35 A |
| 3,343,839 | 9/1967 | Borah | 273/164 X |
| 3,604,407 | 9/1974 | Wilson | 124/35 A |
| 3,800,774 | 4/1974 | Troncoso | 124/35 A |

*Primary Examiner*—Richard C. Pinkham
*Assistant Examiner*—William R. Browne
*Attorney, Agent, or Firm*—Weiser, Stapler & Spivak

[57] ABSTRACT

A bow string drawing and releasing device including a generally U-shaped, rigid frame having a rearwardly positioned web and integral legs which extend forwardly therefrom and which bend toward each other to define a narrow opening. A flexible, U-shaped jaw member is longitudinally reciprocal within the frame and is normally biased to a forward position wherein the jaws are closed and locked by the bent legs to retain the bow string. By pulling the jaw member rearwardly relative to the frame, the jaws are opened in a trigger action to release the bow string.

23 Claims, 9 Drawing Figures

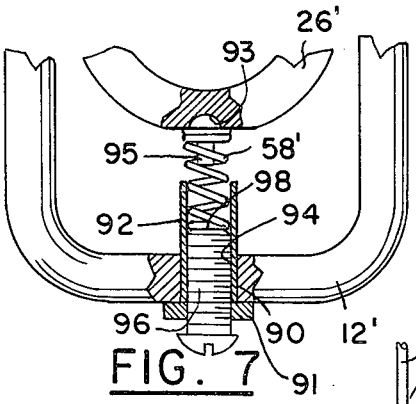
FIG. 7
FIG. 4
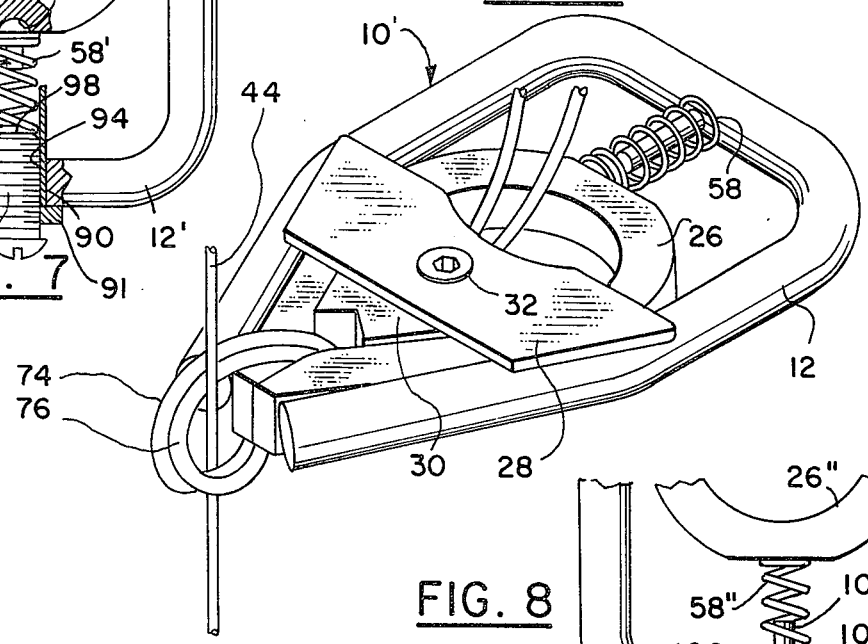
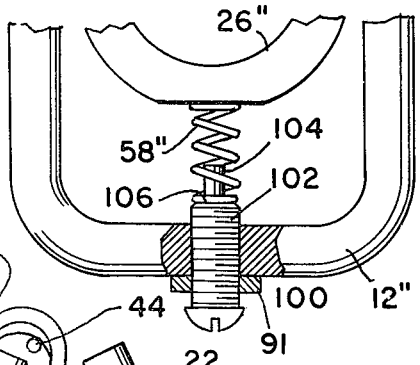
FIG. 8
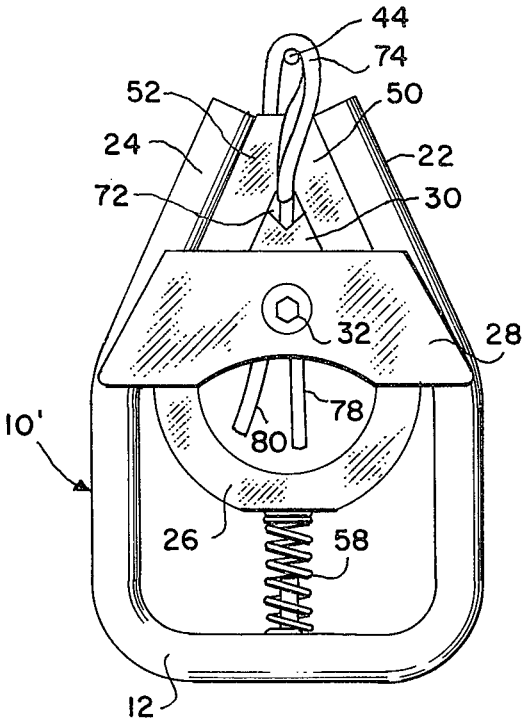
FIG. 5
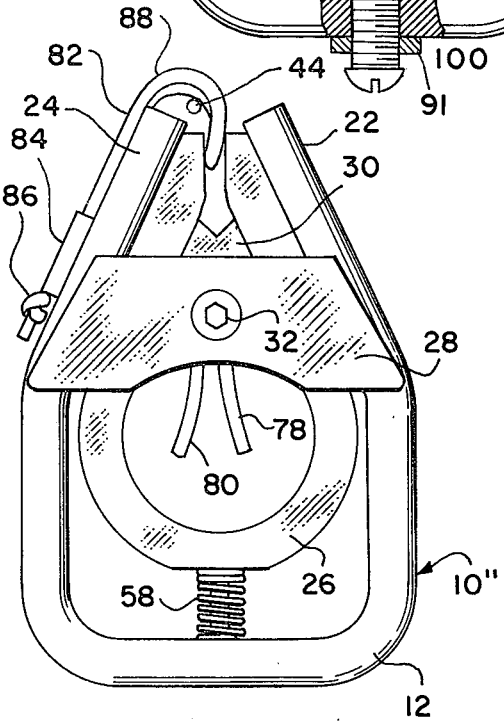
FIG. 6

BOW STRING DRAWING AND RELEASING DEVICE

BACKGROUND OF THE INVENTION

The present invention relates generally to the field of archery equipment, and more particularly, is directed to a novel bow string drawing and releasing device.

The present invention is directed to a device which can be manually held and which is designed to engage the string of an archer's bow to aid in the drawing back of the bow string. When engaging in the sport of archery, it is well known practice to employ a bow including a bow string for use in shooting arrows. The speed, accuracy and distance to which the arrows can be propelled is a direct function of the spring constant of the bow and the strength of the archer in pulling back the bow string through a distance to directly overcome the natural spring bias of the bow itself. As the bows become sturdier, they offer a greater resistance to bending and therefore require greater strength on the part of the archer to produce satisfactory results.

Persons who enjoy the sport of archery have found that their ability to draw the bow string has been hampered to a considerable extent by the physical characteristics of the bow and of the bow string itself. Specifically, it has been the usual practice to employ two fingers, namely, the index finger and the middle finger for pulling the bow string rearwardly. This, of course, presents definite limitations in that all of the strength of the archer cannot be readily applied to the bow string by employing only the two fingers for bow drawing purposes. Also, the pressure created by the bow string upon the fingers has a tendency to limit the forces which can be conveniently applied. Because of this, prior workers in the field have attempted to develop various types of mechanical bow trigger mechanisms to thereby permit an archer to employ a mechanical device as an aid to both pulling the bow string rearwardly and in releasing the bow string at the desired moment. U.S. Pat. Nos. 2,488,597 and 2,977,952 are exemplary of the type of prior art bow trigger mechanisms that are presently available.

The prior art bow trigger mechanisms of which I am familiar have proved generally satisfactory in performance, but have been somewhat limited in their application due to the complexity of the systems and in the difficulty in operation presented by such mechanisms. It has been found that it is the natural movement of the archer to pull the bow string rearwardly along a relatively horizontal plane. In order to develop full strength, it is desirable to permit the archer to employ all of his muscular activity directly in line with the path of travel of the arrow as it is pulled horizontally rearwardly. The prior art bow trigger mechanisms have somewhat hampered such movement in that, in most instances, the trigger mechanism has usually been positioned out of longitudinal alignment with the arrow, thereby effectively reducing the forces which can be employed to pull the bow rearwardly.

SUMMARY OF THE INVENTION

The present invention relates generally to the field of archery devices, and more particularly, is directed to a novel bow string drawing and releasing device.

The bow string drawing and releasing device of the present invention includes a rigid, U-shaped yoke or frame member having a rearwardly facing base and a pair of forwardly extending arms integrally connected to the base. The arms bend inwardly to provide a jaw guide and to form a relatively narrow string releasing opening therebetween. A flexible jaw member which is also generally U-shaped in configuration fits within the frame member and has its base spaced from the base of the frame member a sufficient distance to permit movement of the jaw member for bow triggering purposes. The jaw member terminates forwardly in a pair of opposed jaws which are normally biased together to a closed position by the bent legs of the frame member. Pulling the jaw member rearwardly relative to the frame opens the jaws in alignment with the said opening between the legs of the frame member to thereby facilitate releasing the bow string therebetween.

In a preferred embodiment, a spring biases between the base of the frame and the base of the jaw member to continuously urge the jaws to the said closed position. The archer must pull against and overcome the bias of the spring in order to trigger the bow. In another embodiment, a flexible member is affixed to the rigid frame and sufficient slack is provided to form a loop capable of being doubled back upon itself. In use, the loop is engaged about the bow string and then is locked within the jaws. In this manner, when the bow string is pulled rearwardly, utilizing the present invention, any twisting movement which may unintentionally develop during the rearward path of travel will be compensated by twisting of the flexible member and will not cause twisting of the bow string itself. By pulling the jaw member rearwardly relative to the frame, the jaws can be opened for triggering purposes to release the flexible member and to thereby release the bow string at the desired moment without introducing any inaccuracies caused by twisting.

It is therefore an object of the present invention to provide an improved bow string drawing and releasing device of the type set forth.

It is a further object of the present invention to provide a novel bow string drawing and releasing device including means to permit more efficient utilization of the strength of the archer in pulling the bow string rearwardly.

It is another object of the present invention to provide a novel bow string drawing and releasing device including means to mechanically grip the bow string and axially aligned trigger means to release the bow string.

It is another object of the present invention to provide a novel bow string drawing and releasing device including a right U-shaped frame member and a flexible, U-shaped jaw member positioned within the frame member, the frame member guiding the jaw member between bow string engaging and bow string releasing positions.

It is a further object of the present invention to provide a novel bow string drawing and releasing device including a rigid frame, means to apply pulling forces to the draw string by employing at least two fingers and axially aligned trigger means to release the bow string.

It is another object of the present invention to provide a novel bow string drawing and releasing device including a rigid frame member, a resilient jaw member retained within the frame member and having movement relative thereto and flexible twist absorbing means interposed between the frame member and the jaw member to engage and release the bow string.

It is another object of the present invention to provide a novel bow string drawing and releasing device that is inexpensive in manufacture, simple in application and trouble-free when in use.

Other objects and a fuller understanding of the invention will be had by referring to the following description and claims of a preferred embodiment thereof, taken in conjunction with the accompanying drawings wherein like reference characters refer to similar parts throughout the several views and in which:

BRIEF DESCRIPTION OF THE DRAWINGS

FIG. 4 is a perspective view similar to FIG. 1 showing a first modification of the invention.

FIG. 5 is a top plan view of the bow string drawing and releasing device of FIG. 4 with the jaws in closed position.

FIG. 6 is a top plan view similar to FIG. 5 showing a second embodiment of the invention with the jaws in the open position.

FIG. 7 is a partial, top plan view of an embodiment illustrating a spring bias adjustment construction.

FIG. 8 is a partial top plan view similar to FIG. 7 showing a modified spring bias adjustment construction.

DESCRIPTION OF THE PREFERRED EMBODIMENT OF THE INVENTION

Figure 9:
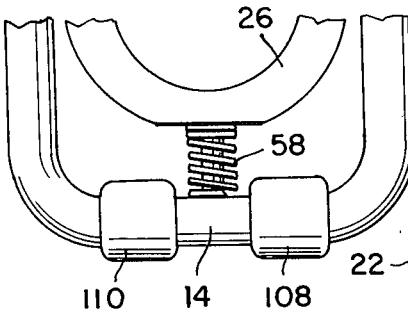
FIG. 9 is a partial, top plan view of an embodiment of the invention illustrating an attachment providing an enlarged gripping area.

Although specific terms are used in the following description for the sake of clarity, these terms are intended to refer only to the particular structure of my invention selected for illustration in the drawings, and are not intended to define or limit the scope of the invention.

Figure 1:
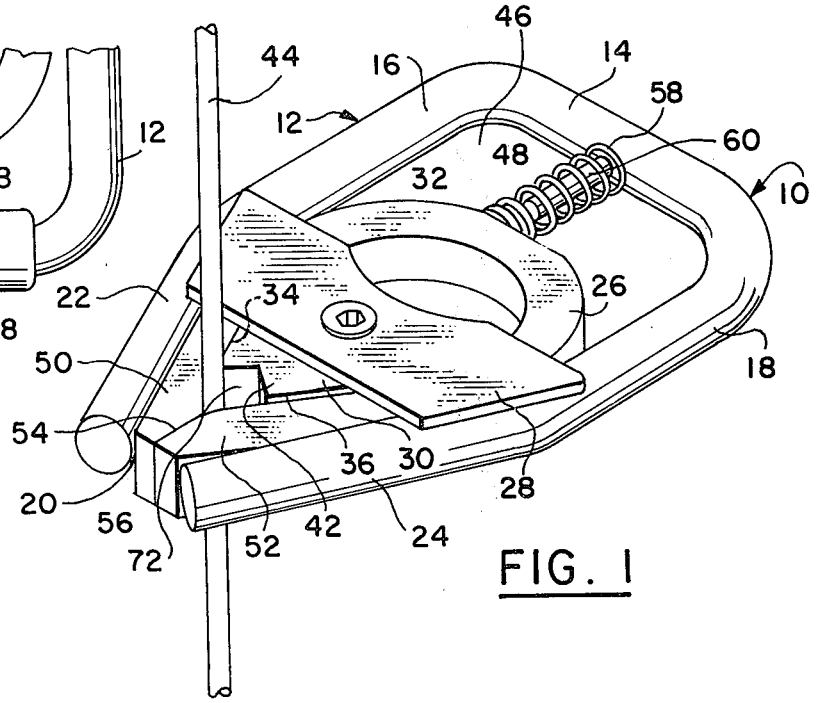
FIG. 1 is a perspective view of the apparatus of the present invention.

Referring now to the drawings, I show in FIG. 1 a bow string drawing and releasing device 10 which includes an outer, rigid, generally U-shaped frame 12 having a closed base 14 suitable for gripping by at least two fingers (not shown) of the user. A pair of right and left similar legs 16, 18 integrally connect to the base 14 and extend forwardly thereof and are bent inwardly to define a constricted front opening 20 therebetween. In the configuration shown, the right and left legs 16, 18 extend to right angles from the base 14 for a distance equal approximately to one half their length. At approximately their midpoints, the legs 16, 18 are bent inwardly to define similar, inclined, extensions 22, 24 for interaction with the jaw member 26 in the manner hereinafter more fully set forth. The frame 12 should be fabricated of a material having sufficient strength to resist deformation under all conditions of use. In a preferred embodiment, I have employed ¼ inch round steel bar stock for this purpose. Material of this greater thickness may be conveniently grasped by the fingers of the user and without building up the enormous pressures encountered when the same forces were applied directly to the bow string.

Front and rear yokes 28 (only one being illustrated) transversely span between the right and left legs 16, 18 and at least one yoke is welded or otherwise secured to the right and left leg extensions 22, 24 to aid in maintaining the rigidity of the device and to assure that the spacing of the extensions 22, 24 at the front opening 20 does not significantly vary when in use. A medially positioned spacer and guide 30 is affixed to the yokes 28 by employing a suitable fastener 32 to maintain the spacer and guide in stationary position relative to the frame 12 under all conditions. The right and left sides 34, 36 of the spacer and guide 30 are inwardly inclined to generally the same angular inclination as the right and left frame leg extensions 22, 24 to thereby form respective right and left guide paths 38, 40 therebetween for the jaws 50, 52 of the jaw member 26 as hereinafter more fully set forth. The spacer and guide member 30 terminates forwardly in a bifurcated end 42 to form a notch-shaped end to receive and cooperate with the bow string 44. It is also possible to construct the frame 12 of adjustable size and shape such as by employing telescoping members to vary the size of the device 10 to conveniently fit the hand of the user.

The jaw member 26 is preferably formed of a relatively strong, resilient material such as polyethylene plastic of suitable size to fit within the space 46 defined within the generally U-shaped rigid frame 12. The jaw member 26 is smaller than the frame 12, is generally U-shaped in configuration and includes an integral closed rear wall 48 which is utilized for triggering purposes as hereinafter more fully set forth. The rear wall 48 integrally joins the forwardly extending jaws 50, 52 which are angularly arranged to conform to and slide along the interior surfaces of the right and left frame leg extensions 22, 24. It will be noted that the right and left jaws 50, 52 respectively position within the right guide path 38 and the left guide path 40 which are defined between the spacer and guide member 30 and the respective right and left frame leg extensions 22, 24. Each jaw 50, 52 is forwardly respectively provided with a longitudinally aligned locking surface 54, 56 which surfaces are pinched together for bow string retaining when the device 10 is employed to pull the bow string 44 rearwardly see FIG. 2. A suitable coil spring 58 biases between the forward surface of the closed base 14 of the frame 12 and the rearward surface of the closed rear wall of the jaw member 26 to continuously urge the jaw member 26 forwardly relative to the frame 12. If desired, a pin 60 in axial alignment with the spring 58 can be affixed to the frame base 14 to conventionally retain and guide the spring 58.

Figure 2:
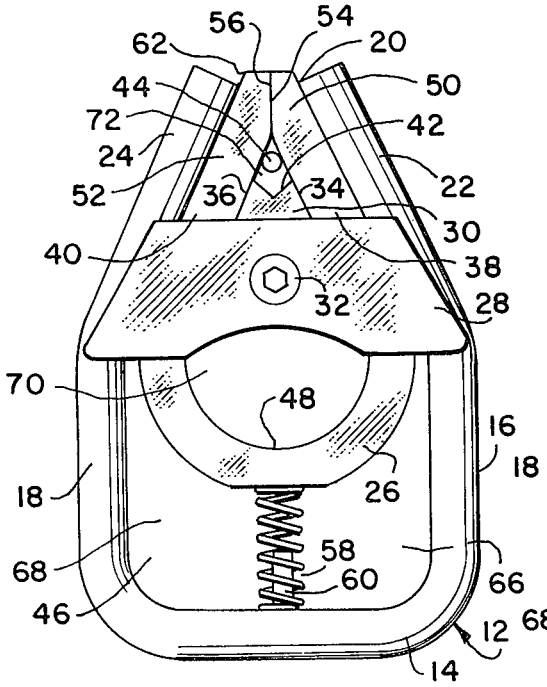
FIG. 2 is a top plan view thereof showing the jaw member in closed position.
Figure 3:
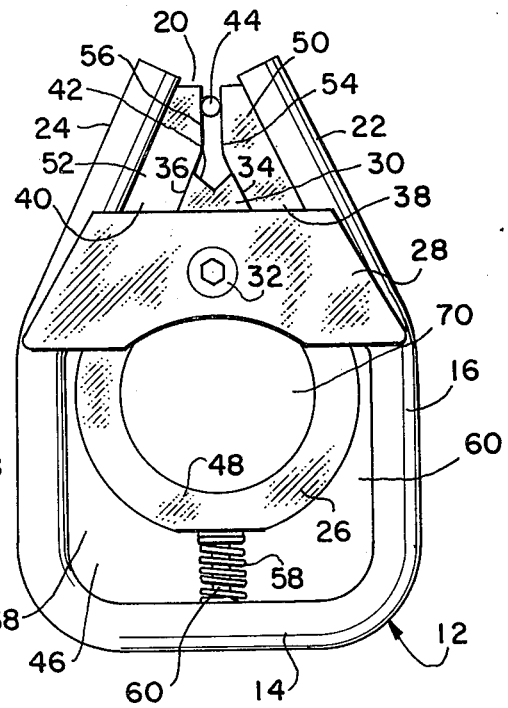
FIG. 3 is a view similar to FIG. 2 showing the jaw member in the bow string releasing position.

Referring now to FIGS. 2 and 3, it will be seen that the jaw member 26 is movable within the frame 12 from a forward, closed, locking position 62 as shown in FIG. 2, to a rearward, open, triggering position 64 as illustrated in FIG. 3. In order to use the device 10, preferably the index finger (not shown) is inserted into the space 66 defined between the frame 14 and the jaw member 26 to the right of the spring 58 and the fourth or ring finger (not shown) is inserted into the space 68 defined between the frame 12 and the jaw member 26 to the left of the spring 58 with the closed base 14 pressed into the palm of the hand of the user. The middle finger inserts through the space 70 defined between the jaw member 26 and the yoke 28 for triggering purposes. By initially pulling the jaw member 26 to the open position 64 as in FIG. 3, to open the jaws 50, 52, the bow string 44 can be positioned within the space 72 (FIGS. 1 and 2) defined between the jaws 50,

52 of the jaw member 26 and the bifurcated end 42 of the spacer and guide member 30. It will be noted that after the jaw member 26 has been pulled to its open position 64 to position the bow string 44 within the space 72, pressure on the base of the jaw member 26 is then released by the middle finger to thereby allow the spring 58 to bias the jaw member 26 forwardly relative to the frame 12 to the locking position 62 of FIG. 2.

The jaws 50, 52 travel in an inclined path between the locking position 62 and the triggering position 64 as defined by the respective right and left guide paths 38, 40. The angular inclination of the right and left leg extensions 22, 24 of the frame 12 angularly guides the jaws 50, 52 and serves to urge the locking surfaces 54, 56 into tight, locking engagement as the jaw member 26 is urged forwardly relative to the frame 12. Thus, the action of the spring 58 serves to tightly interlock the locking surfaces 54, 56 to prevent unwanted escape of the bow string 44 when the bow string is pulled rearwardly. Further, it will be noted that rearward pulling of the bow string when it is positioned within the space 72 also creates forces on the jaw member 26 rearwardly of the locking surfaces 54, 56 which tend to urge the jaw member 26 forwardly relative to the frame 12. These additional forces imposed by the bow string 44 will similarly serve to more tightly lock the locking surfaces 54, 56 due to the inclined orientation of the right and left frame leg extensions 22, 24. Accordingly, both the bias of the spring 58 and the angularly inclination of the frame leg extensions 22, 24 combine to positively prevent unwanted, premature release of the bow string 44.

When pulling rearwardly, it will be noted that all of the energy of the index finger acting within the space 66 and the energy of the ring or fourth finger acting within the space 68 can be fully applied against the closed base 14 for bow string drawing purposes. The nock of the arrow will be applied to the bow string 44 in the usual manner immediately above the device 10 so that the arrow (not shown) will rearwardly follow the bow string when it is drawn rearwardly without further concern being necessary on the part of the archer. When the bow string 44 has been fully drawn to the desired position, the middle finger acting within the space 70 can be pulled rearwardly to apply axially aligned pressure upon the closed rear wall 48 of the jaw member 26 to pull the jaw member 26 to the said triggering position 64 against the bias of the spring 58. As the jaw member 26 is rearwardly pulled relative to the frame 12, the right and left jaws 50, 52 will follow an outwardly inclined path along the right and left guide paths 38, 40 until the locking surfaces 54, 56 separate sufficiently to allow passage of the bow string 44 therebetween. When the jaw member 26 is pulled rearwardly a sufficient distance to the triggering position 64 as in FIG. 3, the locking surfaces 54, 56 will separate sufficiently for the bow string 44 to be released therebetween to thereby propel the arrow (not shown) forwardly in the usual manner.

In the embodiment illustrated in FIGS. 4 and 5, a modified device 10′ includes a frame 12, a jaw member 26, a yoke 28, a spacer and guide member 30 and a spring 58 which are all similarly arranged as in the modification illustrated in FIGS. 1 – 3. In this embodiment, a flexible cord 74 is employed for bow string 44 drawing purposes. Preferably, the flexible cord 74 is formed in a loop 76 and has its end 78, 80 retained in suitable manner between the yoke 28 and the spacer and guide member 30 by employing the fastener 32 in a manner to prevent the flexible cord 74 from pulling free of the modified device 10′.

In order to utilize the modified device 10′ of FIGS. 4 and 5, the loop portion 76 of the flexible cord 78 is looped once about the bow string 44. The closed portion of the loop 76 is then fed into the space 72 which is defined between the spacer and guide member 30 and the jaws 50, 52 in the same manner as hereinbefore set forth relative to the bow string 44 as in FIGS. 1 – 3, by pulling the jaw member 64 to its said triggering position 64. The jaw member is then released, thereby allowing the spring 58 to bias the jaw member 26 to its said closed, locking position 62 to thus retain the loop 76 for bow string 44 drawing purposes. In this manner, it is the flexible cord 74 itself that is retained by the jaw member 26 rather than the bow string 44 to thereby provide a flexible interconnection between the modified device 10′ and the bow string 44. By utilizing the flexible cord 74, should any torsion or twisting movement be introduced to the modified device 10′ by the archer as the bow string is drawn rearwardly, such torsion or twisting will be absorbed by the flexible cord 74 and none of the twist will be imposed upon the bow string 44 itself. Thus, the bow string will always remain unaffected by any inadvertent twist on the part of the archer. Once the flexible cord 74 has been looped about the bow string 44 and the loop 76 has been engaged by the jaws 50, 52, triggering can be accomplished in the same manner as hereinbefore described by simply pulling the jaw member 26 rearwardly relative to the frame 12 to the triggering position 64, to open a space between the locking surfaces 54, 56 to permit the loop 76 to escape therethrough to release the bow string 44.

Referring now to FIG. 6, I show a second modified device 10″ wherein a flexible cord 82 is exteriorly mounted upon one of the frame leg extensions 22 or 24 by employing a rigid keeper 84 which can be welded or otherwise secured to the leg extension. The flexible cord 82 inserts through an opening defined between the keeper and the frame and can be secured thereto by employing a usual knot 86. In this manner, a loop 88 is formed similarly to the loop 76 described in the modification set forth in FIGS. 4 and 5, and the loop 88 will be similarly employed to provide a flexible interconnection between the modified device 10″ and the bow string 44. The length of the cord 82 can thereby be readily varied by simply untying the knot 86 and then retying it when the cord has been adjusted to the desired length.

It will be appreciated that the configuration of the bow string drawing and releasing device 10 can be varied within a wide range of sizes and shapes and still fall within the scope, meaning and intent of this invention. For example, the frame 12 and the jaw member 26 could be made larger or smaller than illustrated to accommodate hands and fingers (not shown) of differing sizes to thereby render the device more comfortable in use. Also, it is conceivable that the overall configuration could be rectangular, triangular or irregular in shape and still produce a completely satisfactory, workable device.

Referring now to FIG. 7, I show a modified frame 12 and modified jaw member 26′ which is longitudinally movable therewithin. The frame 12′ is provided with an axially aligned opening 90 within which is positioned a generally hollow cylindrical guide 92 which may be pressed, threaded or otherwise secured in place. The guide 92 is provided with internal threads 94 to threadedly receive the adjusting bolt 96 therein. A coil spring 58' biases between the rear wall of the jaw member 26'' and the forward end 98 of the bolt 96. Accordingly, as the bolt 96 is turned within the threaded opening 94, the bias of the spring 58' can be readily adjusted by varying the preset spring length. A lock nut 91 is threadedly engaged on the threads of the bolt 96 to lock the bolt in any desired longitudinal position. When it is desired to decrease spring pressure, the bolt 96 should be turned outwardly to increase the spring length and vice versa. If desired, the rear of the jaw member 26' could be provided with an axially aligned dimple 93 of suitable size to receive and retain therein the head of a keeper 95. The keeper extends rearwardly in axial alignment and serves to maintain the orientation of the spring 58' relative to the jaw member 26' and the frame 12. The spring 58' surrounds the keeper 95 and accordingly cannot be accidentally laterally moved relative to the jaw member.

In FIG. 8, I show another modified frame 12'' and modified jaw member 26'' wherein a threaded opening 100 is provided in the base of the frame in axial alignment. An adjusting bolt 102 turns within the opening for spring tension adjusting purposes. The bolt 102 terminates forwardly in an axially aligned finger 104 which extends forwardly of the shoulder 106. The finger 104 enters the spring interior for guiding purposes and the shoulder 106 receives one end of the spring 58'' thereon. Thus, as the bolt 102 is turned within the threaded opening 100, the length of the spring 58'' can be readily varied to thereby increase or decrease the spring bias for trigger sensitivity adjustment purposes.

In FIG. 9 I show a triggering device similar to that illustrated in FIG. 1 wherein the closed base 14 of the frame is equipped with enlarged pads 108, 110. Each pad 108, 110 positions laterally of the spring 58 and substantially covers one half of the frame base 14 to provide areas of enlarged diameter to be gripped by the fingers (not shown) of the user. I contemplate fabricating the pads 108, 110 of sturdy resilient material such as rubber or polyethylene to cushion the fingers as the bow string 44 is pulled rearwardly. The increase in diameter of the pads 108, 110 distributes the forces created by the pulling of the bow string over a larger area of the fingers to thereby reduce the forces imposed per square inch. In this manner, greater forces can be brought into use by the archer with appreciably less discomfort.

Although I have described the present invention with reference to the particular embodiments therein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

I claim:

1. In a drawing and releasing device to draw and release a bow string, the combination of A. a frame,
  1. said frame having a base and a right leg and a left leg extending from the base,
  2. said right and left legs defining an opening therebetween, 3. said legs and said base defining a space therewithin;

B. a jaw member cooperating with said frame and being positioned in the said space,
  1. said jaw member being movable within the said space between a bow string locking position and a triggering position,
  2. said jaw member including a rear wall and a pair of jaws forwardly extending therefrom,
  3. said jaw member including a locking surface on each jaw, said locking surfaces coacting to retain the bow string within the said space when in the locking position,
    a. said locking surfaces being maintained in tight contact when the jaw member is in the said locking position,
    b. said locking surfaces defining a passage therebetween when the jaw member is moved to the said triggering position which is sufficiently wide to pass a bow string between the locking surfaces; and C. means to urge the jaw member to the said locking position a portion of said means contacting the base of the frame and the rear wall of the jaw member.

2. The bow string drawing and releasing device of claim 1, wherein said means include a spring, said spring biasing between a portion of the frame and a portion of the jaw member.

3. The bow string drawing and releasing device of claim 2, wherein the device has a longitudinal axis and wherein the spring aligns with the longitudinal axis.

4. The bow string drawing and releasing device of claim 3, wherein the jaw member includes a closed rear wall and wherein the spring biases between the rear wall of the jaw member and the base of the frame.

5. The bow string drawing and releasing device of claim 2 and adjusting means to vary the bias of the spring for trigger adjustment purposes.

6. The bow string drawing and releasing device of claim 5 wherein the adjusting means include a threaded opening provided in the frame base and a bolt threadedly engaged in the opening, wherein the portion of the spring biasing against the frame contacts the bolt whereby the bolt may vary the length of the spring as it is turned within the threaded opening.

7. The bow string drawing and releasing device of claim 6 and spring guide means extending from the base towards the jaw member to guide the spring into axial alignment with the device.

8. The bow string drawing and releasing device of claim 7 wherein the guide means include a hollow cylindrical guide which extends forwardly of the frame base, a portion of the spring being positioned within the hollow interior of the guide.

9. The bow string drawing and releasing device of claim 8 wherein the guide means include an axially aligned finger forwardly extending from the bolt, the said finger being surrounded by portions of the spring to axially retain the spring.

10. The bow string drawing and releasing device of claim 6 and locking means to lock the adjusting means in a selected position to maintain the length of the spring for the desired spring tension.

11. The bow string drawing and releasing device of claim 1, wherein a portion of the jaw member closes the opening between the right and left legs when in the locking position.

12. The bow string drawing and releasing device of claim 1, wherein the frame is composed of non-resilient material and the jaw member is fabricated of resilient material.

13. The bow string drawing and releasing device of claim 1, wherein the means include angularly inclined means to guide a portion of the jaw member in an inclined path between the said locking position and the said triggering position.

14. The bow string drawing and releasing device of claim 1 and flexible means to releasingly engage the bow string.

15. The bow string drawing and releasing device of claim 14 wherein the flexible means include a length of cord having two ends, a portion of said cord being affixed to the device.

16. The bow string drawing and releasing device of claim 15 wherein the cord is formed into a closed loop by connecting the ends to the device, the said loop being releasably retained by the locking surfaces for bow string drawing purposes.

17. The bow string drawing and releasing device of claim 16 and cord length adjusting means provided in the device to easily adjust the length of the cord.

18. The bow string drawing and releasing device of claim 1 and pad means connected to the frame base to increase the surface area of the frame base.

19. The bow string drawing and releasing device of claim 18 wherein the pad means are resilient.

20. In a drawing and releasing device to draw and release a bow string, the combination of A. a frame,
   1. said frame having a base and a right leg and a left leg extending from the base,
   2. said right and left legs defining an opening therebetween,
   3. said legs and said base defining a space herewithin B. a jaw member cooperating with said frame and being positioned in the said space,
   1. said jaw member being movable within the said space between a bow string locking position and a triggering position,
   2. said jaw member including a pair of locking surfaces which coact to retain the bow string within the said space, when in the locking position,
      a. said locking surfaces being maintained in tight contact when the jaw member is in the said locking position,
      b. said locking surfaces defining a passage therebetween when the jaw member is moved to the said triggering position which is sufficiently wide to pass a bow string between the locking surfaces; and C. means to urge the jaw member to the said locking position,
   1. the means including angularly inclined means to guide a portion of the jaw member in an inclined path between the said locking position and the said triggering position,
   2. the inclined means comprising an angularly bent portion of each of the said right and left legs, the said angularly bent portions being bent inwardly towards each other to define the said opening.

21. The bow string drawing and releasing device of claim 20, and a spacer and guide member retained within the said space to guide the jaw member between the locking position and the triggering position.

22. The bow string drawing and releasing device of claim 21, wherein the spacer and guide member include angularly inclined sides, each said side being spaced from and parallel to an angularly bent leg to define a pair of inwardly inclined guide paths therebetween.

23. The bow string drawing and releasing device of claim 22, wherein a first portion of the jaw member position in one guide path and a second portion of the jaw member position within the other guide path, the said jaw member portions moving within the inclined guide paths when the jaw member is moved between the said locking position and the said triggering position.

* * * * *